US007980683B2

(12) United States Patent
Bansyo

(10) Patent No.: US 7,980,683 B2
(45) Date of Patent: Jul. 19, 2011

(54) INKJET PRINTER WITH INK RECYCLING AMOUNT CHANGING UNITS

(75) Inventor: Toshihiro Bansyo, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 341 days.

(21) Appl. No.: 12/320,905

(22) Filed: Feb. 9, 2009

(65) Prior Publication Data

US 2009/0213163 A1 Aug. 27, 2009

(30) Foreign Application Priority Data

Feb. 21, 2008 (JP) ..... 2008-040246

(51) Int. Cl.
*B41J 2/175* (2006.01)

(52) U.S. Cl. ..... 347/85; 347/6; 347/7; 347/17; 347/18; 347/89

(58) Field of Classification Search ..... 347/6, 7, 347/17, 18, 89, 85
See application file for complete search history.

(56) References Cited

U.S. PATENT DOCUMENTS

| | | | | |
|---|---|---|---|---|
| 5,291,215 | A * | 3/1994 | Nozawa et al. | 347/18 |
| 6,174,055 | B1 * | 1/2001 | Sugikubo et al. | 347/89 |
| 7,125,110 | B2 * | 10/2006 | Merz et al. | 347/89 |
| 2008/0284809 | A1 * | 11/2008 | Okawa | 347/17 |

FOREIGN PATENT DOCUMENTS

JP 2006088575 * 4/2006

* cited by examiner

*Primary Examiner* — Julian D Huffman
*Assistant Examiner* — Sharon A Polk
(74) *Attorney, Agent, or Firm* — Manabu Kanesaka

(57) ABSTRACT

In an inkjet printer where an ink recycling path for recycling ink is formed by connecting among an ink head, an upstream tank, and a downstream tank, the inkjet printer includes a temperature detecting unit that detects a temperature of recycling ink, a temperature changing unit that is installed in the ink recycled path and changes the temperature of the recycling ink so that the temperature of the recycling ink reaches a predetermined temperature, and an ink recycling amount changing unit that is installed at the upstream tank and changes an ink recycling amount according to the change in temperature of the recycling ink. Time required to make the temperature of the recycling ink reach the predetermined temperature can be shortened.

7 Claims, 2 Drawing Sheets

INKJET PRINTER WITH INK RECYCLING AMOUNT CHANGING UNITS

BACKGROUND OF THE INVENTION

1. Field of the Invention

The present invention relates to an ink recycling type inkjet printer that performs printing by discharging a recycled ink from an ink head, and more particularly, to a technology for shortening the time required to make a temperature of a recycled ink reach a predetermined temperature by varying the ink recycling amount.

2. Description of the Related Art

It is known that an inkjet printer performs printing on a recording medium, such as printing paper, by discharging ink from a nozzle of an ink head. Further, as the inkjet printer, there is an ink recycling type inkjet printer that continuously recycles ink at the time of a printing state so as to cool ink or remove wastes in an ink channel.

The ink recycling type inkjet printer includes an ink recycling path to recycle ink, wherein a downstream side and an upstream side of the ink recycling path are installed with ink tanks through the ink head. Further, a pump, which applies pressure so as to recycle the ink, is installed between the ink tanks.

Further, the ink recycling type inkjet printer is installed with a temperature sensor that detects at all times whether or not a temperature of ink (recycled ink) being recycled through the ink recycling path at the time of a printing state is a temperature (predetermined temperature) suitable for printing. At this time, if the temperature of the recycling ink is lower than the predetermined temperature, viscosity of ink is increased, such that when a discharge of the ink is poor. To the contrary, if the temperature of the recycling ink is higher than the predetermined temperature, viscosity of the ink is decreased, such that an amount of ink discharged from the nozzle is increased, causing the printing quality to change.

For these reasons above, in the case where the inkjet printer is not used for a long time, etc., when the temperature of ink is at a low temperature, there is a need to increase (warm up) the temperature of the recycled ink using a heating unit, which is installed in the ink recycling path, while recycling the ink for a predetermined time so as to generate optimal printing. Further, for continuous printing over a long period of time, when the recycling ink is at a high temperature, the temperature of the recycling ink should be reduced by a cooling unit that is installed in the ink recycling path.

Moreover, the ink head can be cooled by making the ink head be configured with an ink recycling structure, such that the ink head is used for the ink recycling type inkjet printer.

For example, an ink head of the ink recycling structure as disclosed in JP-A-2006-88575 is installed with plural individual channels, which are partitioned by plural partition walls configured of a piezoelectric element and are installed between an ink supplying hole and an ink discharging hole inside of the ink head. As a result, the ink supplied from the ink supply hole flows in the individual channels so that most of the ink can be discharged from the nozzles that are installed in the individual channels. However, ink, which is not discharged, is discharged from the ink discharging hole and-then recycles through the ink recycling path as described above and re-supplied to the ink head. With the ink head as described above, since the ink head heated due to continuous printing over a long period of time is cooled by the recycling ink within the ink head, continuous printing time can be extended.

However, in order for the ink recycling type inkjet printer described above to increase the temperature of the recycling ink up to the predetermined temperature at the time of warming up and the like, there is a problem in that more time is required to warm up the ink recycling type inkjet printer as the ink recycling amount is increased. For example, when the ink recycling amount is 1.0 [L], the specific heat of the recycling ink is 3.0 [J/g*K] and the density of the recycling ink is 1.0 [g/cm$^3$], thus, the heat capacity of the recycling ink becomes 3,000 [J/K] and even if a heater having 200 W output is used, it takes 5 to 6 minutes to increase the temperature of the recycling ink to 5° C. Further, if the output of the heater is increased so as to shorten the time required to increase the temperature, a large amount of power is consumed.

Furthermore, even though the temperature increase of the ink head is suppressed by using the ink head configured as the ink recycling structure as disclosed in JP-A-2006-88575, since the ink is subjected to an increase in temperature due to the heat generated from the ink head recycling the ink through the ink recycling path, the temperature of the recycled ink is still increased. Also, in order to reduce the temperature of the recycling ink up to the predetermined temperature, time is needed, similar to the case of increasing the temperature.

SUMMARY OF THE INVENTION

Accordingly, the present invention proposes to solve the above problems. It is an object of the present invention to provide an inkjet printer capable of shortening the time required to increase a temperature of recycling ink to a predetermined temperature by varying an ink recycling amount according to the temperature of the recycling ink throughout an ink recycling path.

Hereinafter, a configuration according to an exemplary embodiment of the present invention to solve the above-mentioned problems will be described with reference to the accompanying drawings.

An inkjet printer according to claim 1 of the present invention includes an ink head 2 that performs printing by discharging ink; an upstream tank 3 that supplies ink to the ink head 2; and, a downstream tank 4 that receives ink not discharged from the ink head 2, wherein an ink recycling path is formed to recycle ink through a channel connecting the ink head 2, the upstream tank 3 and the downstream tank 4, the inkjet printer including:

a temperature detecting unit that detects at all times a temperature of the ink recycling through the ink recycling path;

a temperature changing unit 20 that is installed in the ink recycling path and changes the temperature of the recycling ink so that the temperature of the recycling ink detected by the temperature detecting unit becomes a predetermined temperature; and ink recycling amount changing units 30 that are installed at the upstream tank 3 and/or the downstream tank 4 and change an ink recycling amount according to a change in temperature of the recycling ink by the temperature changing unit 20.

With the above-mentioned configuration, when the recycling ink in the ink recycling path is higher or lower than the predetermined temperature, the temperature changing unit 20 starts the change (increase or reduction) in temperature of the recycling ink so that the temperature of the recycling ink becomes the predetermined temperature. As a result, the ink recycling amount changing unit 30 changes (for example, to be low) the ink recycling amount, such that the change in temperature can be effectively performed by the temperature changing unit 20.

In the inkjet printer according to claim 2, the ink recycling amount changing unit 30 includes a partition plate 31 that is rotated in the upstream tank 3 and/or the downstream tank 4 to be divided into two partitions and a shaft part 32 that rotates the partition plate 31, and rotates the partition plate 31 at a predetermined angle to change the ink recycling amount that passes through the upstream tank 3 and/or the downstream tank 4.

With the configuration as described above, an inside of at least one of the upstream tank 3 and the downstream tank 4 is divided into two partitions by the partition plate 31 to change an occupied volume of the recycling ink within the tank 3 (4), thereby changing the ink recycling amount passing through the inside of the tank 3 (4). Consequently, one partition within the tank 3 (4) is included in the ink recycling path but the other partition is excluded from the ink recycling path such that ink remaining in the excluded partition is not temporarily included in the recycling ink.

In the inkjet printer according to claim 3, the temperature changing unit 20 includes a heating unit 20*a*, and when the heating unit 20*a* heats the recycling ink, the ink recycling amount is made small by the ink recycling amount changing unit 30.

With the configuration as described above, since the ink recycling amount heated by the heating unit 20*a* is small, the temperature of the recycling ink, which is lower (low temperature) than the predetermined temperature, can reach the predetermined temperature as quickly as possible.

In the inkjet printer according to claim 4, when the temperature of the recycling ink detected by the temperature detecting unit reaches the predetermined temperature while the recycling ink is heated by the heating unit, the ink recycling amount changing unit 30 returns the ink recycling amount to an original ink recycling amount.

With the configuration as described above, the change rate of the temperature of the recycling ink after the temperature of the recycling ink reaches the predetermined temperature can be small.

In the inkjet printer according to claim 5, the temperature changing unit 20 includes a cooling unit 20*b*, and when the cooling unit 20*b* cools the recycling ink, the ink recycling amount is made small by the ink recycling amount changing unit 30.

With the configuration as described above, since the ink recycling amount cooled by the cooling unit 20*b* becomes low, the temperature of the recycling ink, which is higher (high temperature) than the predetermined temperature, can reach the predetermined temperature as quickly as possible.

In the inkjet printer according to claim 6, when the temperature of the recycling ink detected by the temperature detecting unit reaches the predetermined temperature while the recycling ink is cooled by the cooling unit, the ink recycling amount changing unit 30 returns the ink recycling amount into an original ink recycling amount.

With the configuration as described above, similar to the foregoing description, the change rate of the temperature of the recycling ink after the temperature of the recycling ink reaches the predetermined temperature can be small.

In the inkjet printer according to claim 7, when the temperature of the recycling ink detected by the temperature detecting unit is higher than the predetermined temperature just before the ink is recycled through the ink recycling path stops, the ink recycling amount changing unit 30 makes the ink recycling amount small and the ink recycled through the ink recycling path is continued for a predetermined time until the temperature of the recycling ink becomes lower than the predetermined temperature.

With the configuration as described above, the ink recycling amount becomes small by the ink recycling amount changing unit 30, such that it is easy to reduce the temperature of the recycling ink. Also, the temperature of the recycling ink is reduced before the ink recycling stops, making it possible to suppress the reduction in quality of the ink even when the ink recycling stops.

With the ink jet printer according to the present invention, when the recycling ink in the ink recycling path is higher or lower than the predetermined temperature, the temperature changing unit starts the temperature change (increase or reduction) of the recycling ink so that the temperature of the recycling ink becomes the predetermined temperature. Thereby, the ink recycling changing unit changes (for example, to be smaller than) the ink recycling amount, such that the change in temperature can be effectively performed by the temperature changing unit. As a result, time required to make the temperature of the recycling ink reach the predetermined temperature can be shortened and power consumption can be reduced.

Further, with the configuration as described above, an inside of at least one of the upstream tank and the downstream tank is divided into two partitions to change the occupied volume of the recycling ink within the tank, such that the ink recycling amount passing through the inside of the tank is changed, for example, when the ink recycling amount is decreased, time required to change temperature is shortened and when the ink recycling amount is increased, a temperature maintaining time is extended.

Moreover, when the recycling ink is heated by the heating unit, the ink recycling amount is small such that the temperature of the recycling ink, which is lower (low temperature) than the predetermined temperature, can reach the predetermined temperature as quickly as possible. As a result, similar to the above-mentioned effect, the time required to make the temperature of the recycling ink reach the predetermined temperature can be shortened.

In addition, when the recycling ink is cooled by the cooling unit, the ink recycling amount is small such that the temperature of the recycling ink, which is higher (high temperature) than the predetermined temperature, can reach the predetermined temperature as quickly as possible. As a result, similar to the above-mentioned effect, time required to make the temperature of the recycling ink reach the predetermined temperature can be shortened.

Also, when the temperature of the recycling ink reaches the predetermined temperature, the ink recycling amount is returned to the original ink recycling amount, such that the change rate of the temperature of the recycling ink after the temperature of the recycling ink reaches the predetermined temperature can be small.

Further, the ink recycling amount becomes small by the ink recycling amount changing unit, such that it is easy to reduce the temperature of the recycling ink. Therefore, the temperature of the recycling ink is reduced before the recycling of the ink stops, such that the reduction in quality of the ink can be suppressed even when the recycling of the ink stops.

DETAILED DESCRIPTION OF THE PREFERRED EMBODIMENTS

Hereinafter, exemplary embodiments of the present invention will be described in more detail below with reference to the accompanying drawings.

Figure 1:
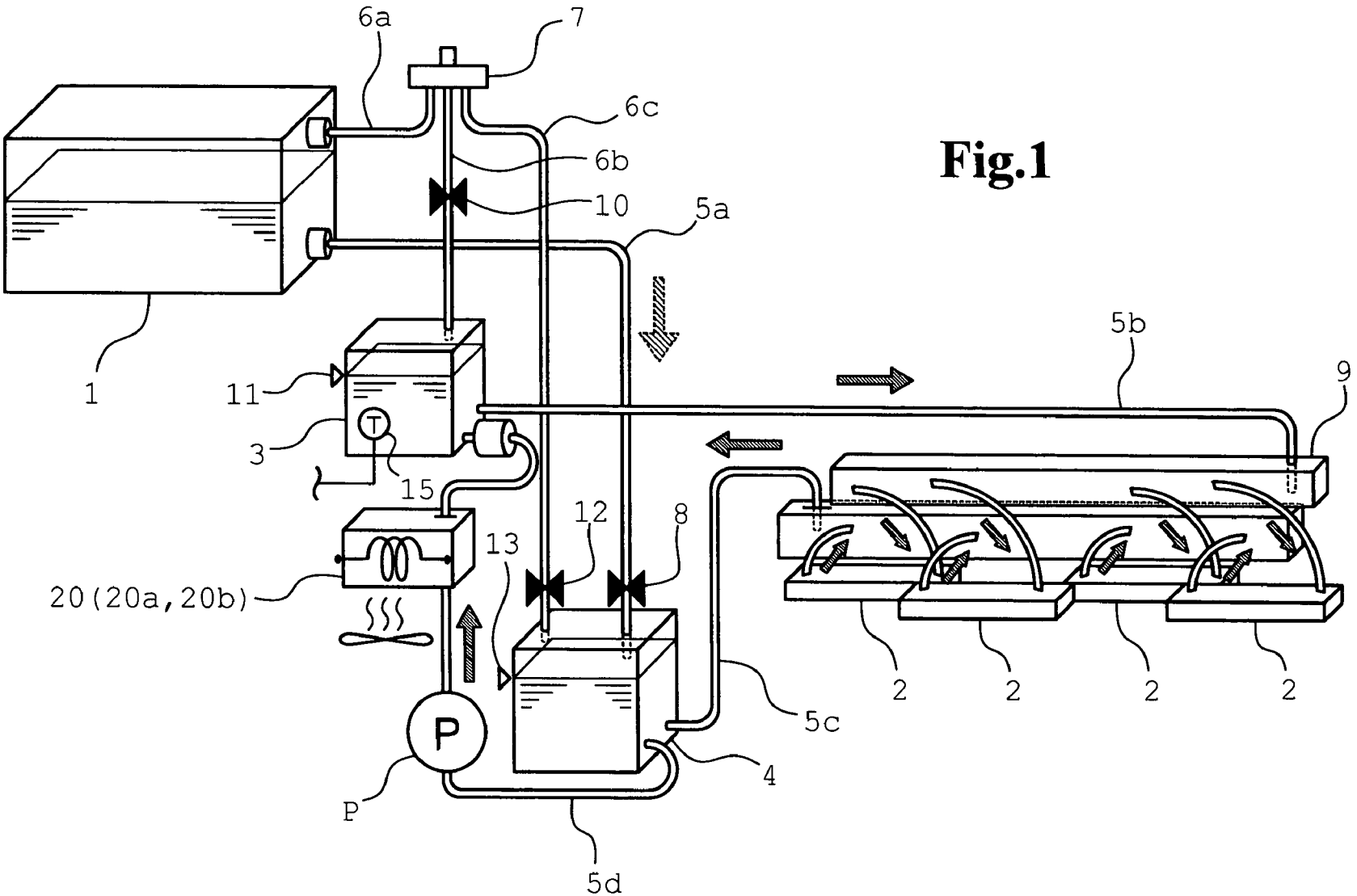
FIG. 1 is a view for explaining a channel configuration of one embodiment of an inkjet printer according to the present invention.
Figure 2C:
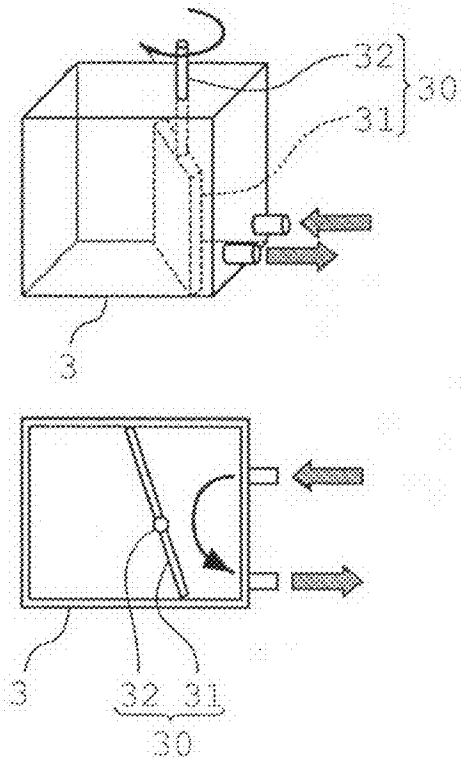
FIGS. 2A to 2C are views for explaining a change process in an ink recycling amount by an ink recycling amount changing unit that is included in the same exemplary embodiment.
Figure 2B:
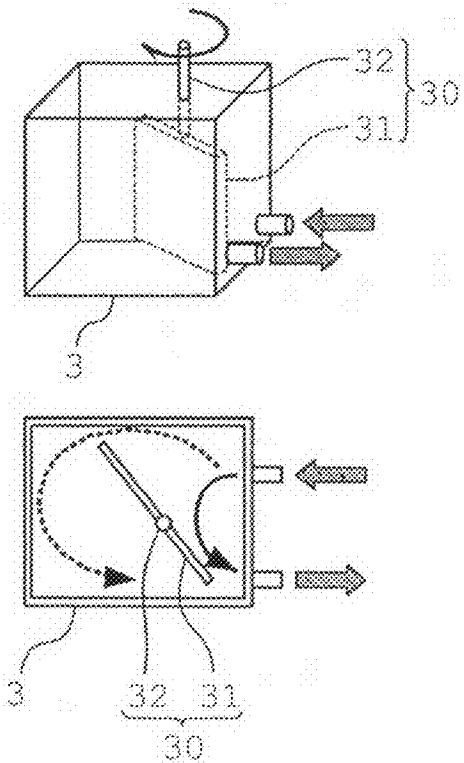
Figure 2A:
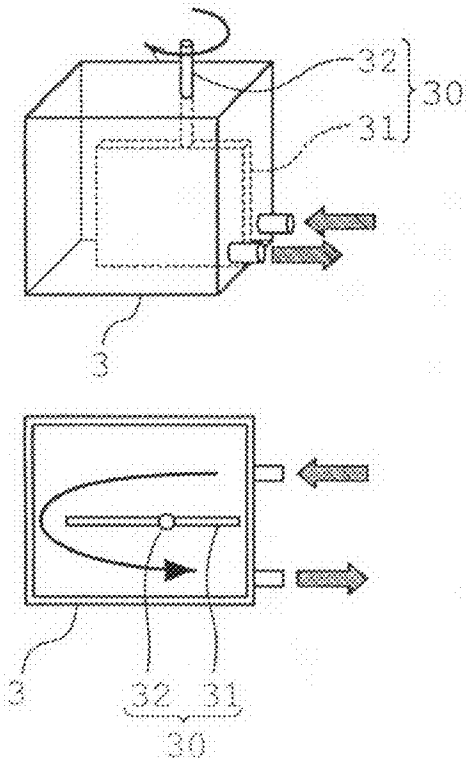

FIG. 1 is a view for explaining a channel configuration of one embodiment of an inkjet printer according to the present invention. FIGS. 2A to 2C are views for explaining a change process in an ink recycling amount by an ink recycling amount changing unit that is included in the same exemplary embodiment.

The inkjet printer according to the exemplary embodiment is an ink recycling type inkjet printer that continuously recycles ink during printing so that ink does not clot in the vicinity of an ink head, in particular, a nozzle.

In FIG. 1, reference numeral 1 denotes an exchangeable ink cartridge, reference numeral 2 denotes an ink head that prints images on a recording medium, such as printing paper, by discharging ink, reference numeral 3 denotes an upstream tank, and reference numeral 4 denotes a downstream tank, wherein between the upstream tank 3 and the downstream tank 4 is a channel connected by ink channels 5*a* to 5*d*. Further, in the channel configuration, ink from the ink cartridge 1 is first supplied to the downstream 4 and then supplied from the downstream tank 4 to the upstream tank 3. Next, the ink is supplied from the upstream tank 3 to the ink head 2 and discharged from the ink head 2 to the downstream tank 4, such that it is resupplied from the downstream tank 4 to the upstream tank 3. Further, an ink recycling path for recycling ink is formed among the ink head 2, the upstream tank 3, and the downstream tank 4.

As shown in FIG. 1, an atmospheric opening tube 6*a* is installed at an upper part of the ink cartridge 1. The atmospheric opening tube 6*a* leads to the atmosphere through an air filter 7 to open an inside of the ink cartridge 1 to the atmosphere. Further, the ink channel 5*a* is installed at a lower part of the ink cartridge 1. The ink channel 5*a* leads to the downstream tank 4 and channel-connects between the ink cartridge 1 and the downstream tank 4. An ink supplying valve (electromagnetic valve) 8 for controlling the opening at the time of supplying ink is installed in the middle of the ink channel 5*a*.

In the present exemplary embodiment, plural (four) ink heads 2 are installed. Each of the ink heads 2 is connected in parallel by an ink distributor 9. Further, the ink distributor 9 is installed with the ink channels 5*b* and 5*c* and each of the ink channels 5*b* and 5*c* leads to the upstream tank 3 and the downstream tank 4 to channel-connect the ink distributor 9 to the upstream tank 3 and the ink distributor 9 to the downstream tank 4, respectively. Ink supplied from the upstream tank 3 is distributed and supplied to each ink head 2 by the ink distributor 9. Also, the inside of each of the ink heads 2 is formed in an ink recycling structure and ink, which is not discharged from each ink head 2, is discharged from the ink distributor 9 to the downstream tank 4.

An atmospheric opening tube 6*b* is installed at an upper part of the upstream tank 3. The atmospheric opening tube 6*b* leads to the atmosphere through the air filter 7 to open an inside of the tank 3 to the atmosphere. Further, an electromagnetic valve 10 for controlling the opening and closing is installed at the middle of the atmospheric opening tube 6*b*. Further, a liquid surface sensor 11 for detecting a height of an ink liquid surface in the tank 3 is installed at the upstream tank 3. Further, a thermistor (temperature sensor 15) as a temperature detection unit is installed in the upstream tank 3. A temperature (detecting signal) of the recycling ink, which is detected by the temperature sensor, is output to a controlling unit (not shown). Moreover, the temperature sensor may also be installed at the ink head. In addition, an ink recycling amount changing unit to be described below is installed in the upstream tank 3.

Further, in the channel configuration of FIG. 1, the upstream tank 3 opens the electromagnetic valve 10 of the atmospheric opening tube 6*b* at the time the ink is recycling, such that it opens to the atmosphere and ink can be supplied to the ink head 2 by the height difference (water head difference) between an ink liquid surface in the upstream tank 3 and a nozzle surface (not shown) of the ink head 2.

An atmospheric opening tube 6*c* is installed at an upper part of the downstream tank 4. The atmospheric opening tube 6*c* leads to the atmosphere through the air filter 7 to open the inside of the tank 4 to the atmosphere. An electromagnetic valve 12 for controlling the opening and closing is installed at the middle of the atmospheric opening tube 6*c*. Further, a liquid surface sensor 13 for detecting the height of the ink liquid surface in the tank 4 is installed at the downstream tank 4.

Between the upstream tank 3 and the downstream tank 4 is channel-connected by an ink channel 5*d* and a pump P is installed in the middle of the ink channel 5*d*. Further, in the channel configuration of FIG. 1, the electromagnetic valve 12 of the atmospheric opening tube 6*c* is closed at the time the ink is recycling such that the inside of the downstream tank 4 is sealed, and the pump P generates negative pressure, thus allowing the recycling of the ink to be performed. Also, the channel configuration of FIG. 1, even though the ink is recycled along the ink recycling path by opening the upstream tank 3 to the atmosphere by closing the downstream tank 4 to allow the pump P to generate negative pressure, the present exemplary embodiment is not limited to the ink recycling as described above. For example, the ink recycling can be performed by opening both tanks 3 and 4 to the atmosphere and using the water head difference between the ink liquid surface of each of the tanks 3 and 4 and the nozzle surface of the ink head 2. The ink recycling can be properly selected by opening and closing each of the electromagnetic valves 10 and 12.

Further, a temperature changing unit 20, which changes the temperature of the recycling ink, is installed in the middle of the ink channel 5*d*. The temperature changing unit 20 includes a heater 20*a* as a heating unit and a cooling fan 20*b* as a cooling unit and is a unit that maintains the temperature of the recycling ink to a predetermined temperature by heating or cooling the recycling ink when the temperature of the recycling ink is higher or lower than the predetermined temperature (15 to 40° C.).

Further, the ink recycling amount changing units 30 described above, which are installed in the upstream tank 3 and/or the downstream tank 4 (in the present exemplary embodiment, the upstream tank 3 that is opened to the atmosphere) is a unit that changes the ink recycling amount. As shown in FIG. 2, the ink recycling amount changing unit 30 includes an approximately rectangular partition plate 31 and a shaft part 32 that rotates the partition plate 31. As a material used for the partition plate 31, materials having low thermal conductivity and small heat capacity such as, for example, plastic and the like, can be used. Moreover, the partition plate 31 is a hollow structure, making it possible to further lower heat conductivity. The shaft part 32 is connected to a driving unit (motor, etc.) that is not shown in FIG. 1). The operation of the driving unit is controlled according to a detection signal from the temperature sensor by the controlling unit. Further, since the upstream tank 3 is opened to the atmosphere, even when the partition plate 31 rotates within the tank 3, the pressure within the ink recycling path is not changed.

Hereinafter, a process of changing the ink recycling amount according to the temperature of the recycling ink with reference to FIG. 2 will be described.

As shown in FIG. 2A, when the ink recycling amount is a general amount, the partition plate 31 of the ink recycling amount changing unit 30 is disposed along a flow direction of the recycling ink that flows into the tank 3 from a supplying hole of the upstream tank 3. At this time, the recycling ink within the upstream tank 3 passes through between the one end of the partition plate 31 and an inner wall of the tank 3 and then discharged from a discharging hole of the tank 3 to the ink channel 5*b* (see FIG. 1).

Next, as shown in FIG. 2B, when the ink recycling amount is slightly smaller (about ¾ of the general amount) than the general amount, the partition plate 31 of the ink recycling amount changing unit 30 is rotatably arranged so that it is inclined with respect to the recycling ink that flows into the tank 3 from the supplying hole of the upstream tank 3. At this time, most of the recycling ink in the upstream tank 3 is interrupted by the partition plate 31 and flows in a partition at the right in the FIG. 2B, such that it is discharged from the discharging hole of the tank 3 to the ink channel 5*b*. Further, the remaining recycling ink flows is partitioned at the left in the FIG. 2B to a gap between one end of the partition plate 31 and the inner wall of the tank 3. Therefore, the recycling ink mostly stays at the left partition while minimally flowing out from a gap between the other end of the partition plate 31 and the inner wall of the tank 3 so that it is joined with the recycling ink of the right partition and discharged from the discharging hole to the ink channel 5*b*.

Next, as shown in FIG. 2C, when the ink recycling amount is about a half of a general amount, the partition plate 31 of the ink recycling amount changing unit 30 is rotatably arranged so that it interrupts the recycling ink that flows into the tank 3 from the supplying hole of the upstream tank 3. At this time, the recycling ink flowing in the upstream tank 3 is only at the right partition in FIG. 2C and discharged from the discharging hole of the tank 3 to the ink channel 5*b*. Further, ink remains at the left partition in FIG. 2C of the upstream tank 3, wherein the ink in the left partition is not included in the recycling ink.

According to the process as described above, the ink recycling amount can be changed by rotating the partition plate 31 of the ink recycling amount changing unit 30 in the upstream tank 3. Further, when the ink recycling amount is returned to the general amount, the process is reversely performed. Further, in FIGS. 2A to 2C, even though the process of stepwise reducing the recycling ink small is described, for example, it may be permitted to directly move a state from FIG. 2A to FIG. 2C or from FIG. 2C to FIG. 2A.

In the exemplary embodiment described above, for example, when increasing temperature so that a low-temperature ink becomes the predetermined temperature at the time of being warmed up, the recycling of ink through the ink recycling path starts and at the same time, the heating of the recycling ink starts by the heater 20*a*. Thereby, the ink recycling amount becomes small by the ink recycling amount changing unit 30. Therefore, if the temperature sensor detects that the temperature of the recycling ink reaches the predetermined temperature, the heating by the heater 20*a* ends and therefore, the ink recycling amount changing unit 30 returns the ink recycling amount to the general amount, making it possible to suppress the reduction of the temperature of the recycling ink that reaches the predetermined temperature.

Further, when the temperature of the recycling ink, which becomes high temperature due to continuous printing over a long period of time, is decreased to reach predetermined temperature, the cooling of the recycling ink starts using the cooling fan 20*b* and therefore, the ink recycling amount becomes small by the ink recycling amount changing unit 30. Therefore, if the temperature sensor detects that the temperature of the recycling ink reaches the predetermined temperature, the cooling by the cooling fan 20*b* ends and therefore, the ink recycling amount changing unit 30 returns the ink recycling amount to the general amount, making it possible to suppress the increase of the temperature of the recycling ink that reaches the predetermined temperature.

Further, just before the recycling of ink in the ink recycling path stops, when the temperature sensor detects that the temperature of the recycling ink is higher than the predetermined temperature, the ink recycling amount becomes small due to the ink recycling amount changing unit 30 and the temperature of the recycling ink is reduced by continuously recycling ink for a predetermined time. Thereby, the reduction in quality of ink can be suppressed even when the ink recycling stops.

With the exemplary embodiment described above, when the recycling ink in the ink recycling path is higher or lower than the predetermined temperature (15 to 40° C.), the change (increase or reduction) in the temperature of the recycling ink starts so that the temperature changing unit 20 (heater 20*a* or cooling fan 20*b*) becomes the predetermined temperature. Thereby, the ink recycling amount changing unit 30 makes the ink recycling amount small, such that the temperature changing unit 20 can effectively change the temperature. As a result, time required to make the temperature of the recycling ink reach the predetermined temperature can be shortened and power consumption can be reduced.

For example, the ink recycling amount becomes small when the recycling ink is heated by the heater 20*a*, such that the temperature of the recycling ink lower than the predetermined temperature (15° C.) can reach the predetermined temperature as rapidly as possible. As a result, time required to increase the temperature of the recycling ink can be shortened.

For example, the ink recycling amount becomes small when the recycling ink is cooled by the cooling fan 20*b*, such that the temperature of the recycling ink higher than the predetermined temperature (40° C.) can reach the predetermined temperature as quickly as possible. As a result, time required to reduce the temperature of the recycling ink can be shortened.

Moreover, when the temperature of the recycling ink reaches the predetermined temperature (15 to 40° C.), the ink recycling amount is returned to the original ink recycling amount, such that the change rate of temperature of the recycling ink after the temperature of the recycling ink reaches the predetermined temperature can be small.

In addition, although the foregoing exemplary embodiment describes a configuration where the temperature sensor and the ink recycling amount changing unit 30 are installed at the upstream tank 3, the configuration where they are installed at the downstream tank 4 is also possible. Thereby, a channel configuration where the inside of the downstream tank 4 is opened to the atmosphere can change the ink recycling amount. Also, the ink recycling amount changing unit 30 is installed at the upstream tank 3 and the downstream tank 4, such that the ink recycling amount, which can be small, is twice the exemplary embodiment described above and temperature can be changed more effectively than the exemplary embodiment described above and time required to make the temperature of the recycling ink reach the predetermined temperature can be further shortened.

What is claimed is:

1. An inkjet printer comprising:

an ink head that performs printing by discharging ink;

an upstream tank that supplies ink to the ink head; and, a downstream tank that receives ink not discharged from the ink head, wherein an ink recycling path is formed to recycle ink through a channel connecting the ink head, the upstream tank, and the downstream tank, the inkjet printer further comprising:

a temperature detecting unit that detects a temperature of the ink recycling through the ink recycling path;

a temperature changing unit that is installed in the ink recycling path and changes the temperature of the recycling ink so that the temperature of the recycling ink detected by the temperature detecting unit becomes a predetermined temperature; and ink recycling amount changing units that are installed at the upstream tank and/or the downstream tank and change an ink recycling amount according to a change in temperature of the recycling ink by the temperature changing unit.

2. The inkjet printer according to claim 1, wherein the ink recycling amount changing unit includes a partition plate that is rotated in the upstream tank and/or the downstream tank to be divided into two partitions and a shaft part that rotates the partition plate, and rotates the partition plate at a predetermined angle to change the ink recycling amount that passes through the upstream tank and/or the downstream tank.

3. The inkjet printer according to claim 2, wherein the temperature changing unit includes a heating unit, and when the heating unit heats the recycling ink, the ink recycling amount is made small by the ink recycling amount changing unit.

4. The inkjet printer according to claim 3, wherein when the temperature of the recycling ink detected by the temperature detecting unit reaches the predetermined temperature while the recycling ink is heated by the heating unit, the ink recycling amount changing unit returns the ink recycling amount to an original ink recycling amount.

5. The inkjet printer according to claim 4, wherein the temperature changing unit includes a cooling unit, and when the cooling unit cools the recycling ink, the ink recycling amount is made small by the ink recycling amount changing unit.

6. The inkjet printer according to claim 5, wherein when the temperature of the recycling ink detected by the temperature detecting unit reaches the predetermined temperature while the recycling ink is cooled by the cooling unit, the ink recycling amount changing unit returns the ink recycling amount into an original ink recycling amount.

7. The inkjet printer according to claim 6, wherein when the temperature of the recycling ink detected by the temperature detecting unit is higher than the predetermined temperature just before the recycling of ink in the ink recycling path stops, the ink recycling amount changing unit makes the ink recycling amount small and the recycling of the ink through the ink recycling path is continued for a predetermined time until the temperature of the recycling ink becomes lower than the predetermined temperature.

* * * * *